US007762483B2

(12) United States Patent
Andreae-Jäckering

(10) Patent No.: US 7,762,483 B2
(45) Date of Patent: Jul. 27, 2010

(54) AIR VORTEX MILL FOR MILL DRYING A FLOWABLE PRODUCT AND METHOD FOR USING THE MILL

(75) Inventor: Michael Andreae-Jäckering, Münster (DE)

(73) Assignee: Altenburger Maschinen Jäckering GmbH, Hamm (DE)

( * ) Notice: Subject to any disclaimer, the term of this patent is extended or adjusted under 35 U.S.C. 154(b) by 849 days.

(21) Appl. No.: 11/600,376

(22) Filed: Nov. 16, 2006

(65) Prior Publication Data

US 2007/0114308 A1 May 24, 2007

(30) Foreign Application Priority Data

Nov. 22, 2005 (DE) ..... 10 2005 055 563

(51) Int. Cl.
*B02C 19/06* (2006.01)

(52) U.S. Cl. ..... 241/5; 241/39; 241/188.1

(58) Field of Classification Search ..... 241/57, 241/275, 39, 188.1, 186.1, 185.5, 5
See application file for complete search history.

(56) References Cited

U.S. PATENT DOCUMENTS

| | | | | |
|---|---|---|---|---|
| 4,747,550 | A | 5/1988 | Jackering | 241/55 |
| 5,984,212 | A | 11/1999 | Andreae-Jackering | 241/19 |

FOREIGN PATENT DOCUMENTS

| | | |
|---|---|---|
| AT | 227515 | 5/1963 |
| DE | 38 11 910 A1 | 10/1989 |
| DE | 42 00 827 C2 | 7/1993 |
| EP | 0 796 660 A1 | 9/1997 |

*Primary Examiner*—Faye Francis
(74) *Attorney, Agent, or Firm*—Fay Sharpe LLP

(57) ABSTRACT

An air vortex mill (1) mill dries a flowable product in a gas-/air flow-through grinding chamber (3) with several grinding stages arranged in the grinding chamber. The grinding stages are formed by a rotor (4) with a multitude of grinding plates (9) and a stator housing. A device (12, 13) delivers preferably heated carrier gases, as a device (6, 15, 16, 18) delivers the product into the grinding chamber (3). In order to improve the product delivery to the mill (1), one component of the delivery device is a supply line (6) which encircles at least part the circumference of the grinding chamber (3). The supply line (6) is equipped with an inflow (15) for the product to be treated and a plurality of outlet apertures (18) distributed over the circumference of the grinding chamber, for delivering the product into the grinding chamber.

25 Claims, 3 Drawing Sheets

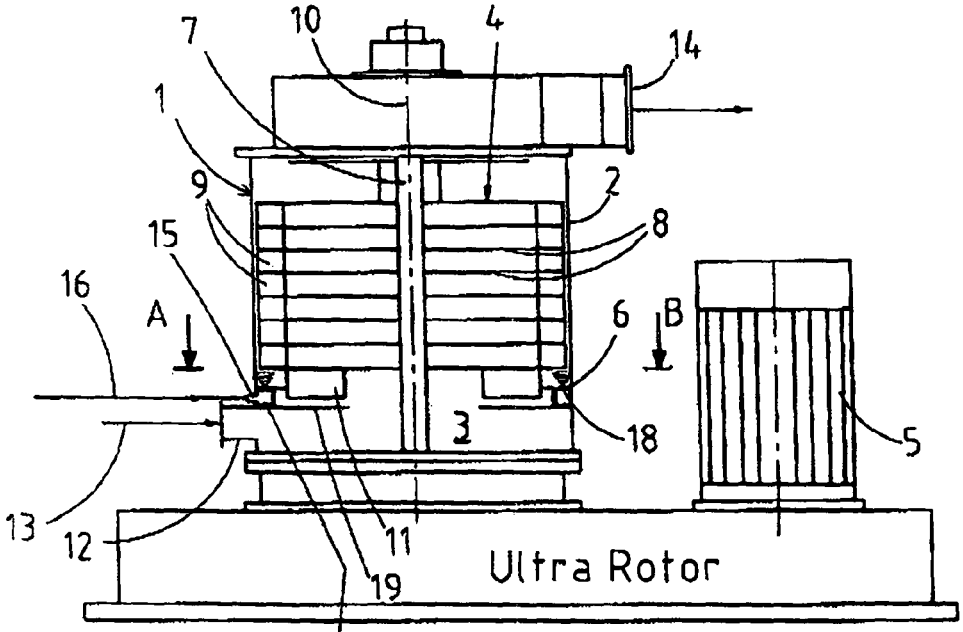
Fig. 1
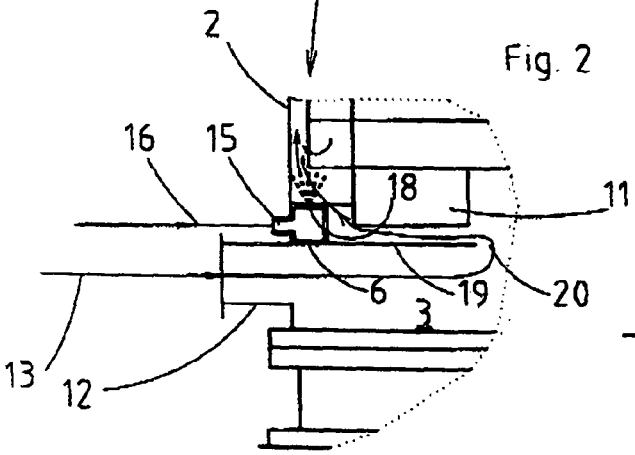
Fig. 2
Fig. 3
A-B
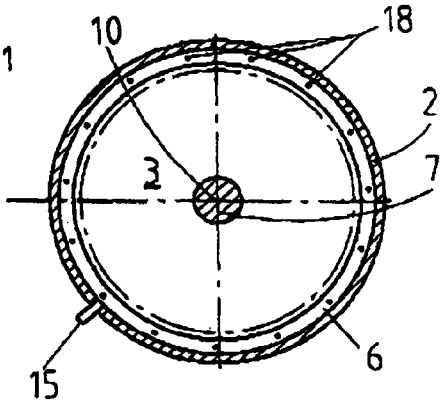
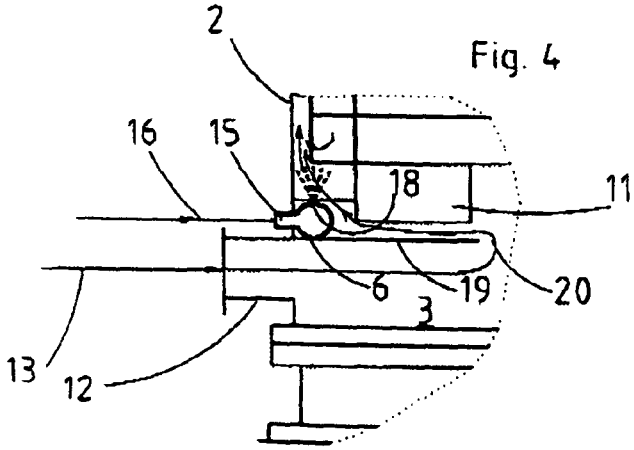
Fig. 4
Fig. 5
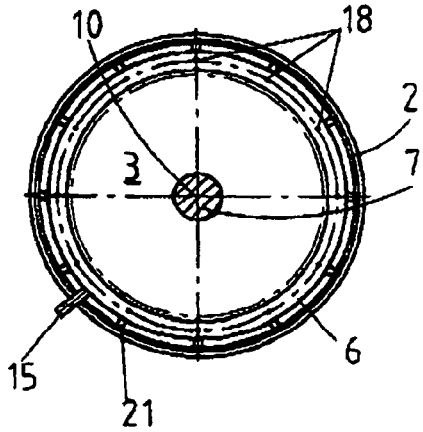

C - D

AIR VORTEX MILL FOR MILL DRYING A FLOWABLE PRODUCT AND METHOD FOR USING THE MILL

BACKGROUND

The invention relates to an air vortex mill for mill-drying a flowable product with a gas-air flow-through mill chamber with several grinding stages arranged in the mill chamber, formed by a rotor comprising a multitude of grinding plates and a stator housing, as well as a device for transporting the product into the mill chamber.

Utilization of an air vortex mill for not only grinding but also and predominantly for drying of wet products is known from U.S. Pat. No. 5,984,212. It is, however, a problem if the products to be dried involve viscous, sticky, oily products, which, if one doses the product laterally into the mill chamber, deposit themselves upon the rotating grinding plates, produce baked-on deposits at the outer walls—in the worst case block the mill and cause it to shut down—and which do not become dry in the short dwelling time.

In the past, one availed oneself of the remedy by first mixing these products outside of the rotor and/or prior to introduction into the rotor, in a continuously or intermittently operating mixing system with already dried product or with other products, so that said entire mixture resulted in a crumbly mass, which could be transported via proportioning screw, and which was then conducted to the rotor for mill-drying.

Such work involving the mixing drum constitutes additional equipment expense, added thermal burden for the retro-mixed product, an additional burden perhaps also for the mill-drying process, need for additional space including further drawbacks.

An attempt to laterally pipe in similar products failed a number of times—the machine either clogged up with too large a nozzle cross-section aperture, or with sufficiently small nozzle cross-section and proper supply pressure, the nozzle became clogged, in particular due to the high temperature of the hot air which flows past the nozzle and the relatively small nozzle cross-section.

In some products, impurities cannot be avoided or cannot be removed through filtration, in particular when viscous products are involved, so that the nozzles can also be come clogged by foreign bodies in the suspension. Utilization or pre-mixing of compressed air with the nozzle and possible cooling of the nozzles did not produce the desired result.

From DE 38 11 910 A1 it is known to press wet product in foil-like thin fashion through a slit extending approximately parallel to the rotor axis, directly into the area between stator housing and grinding plates. This solution did not find acceptance on the market.

The object of the present invention is based on eliminating the problems of the initially described kind in an air vortex mill.

SUMMARY

According to the invention, said object is solved by the characterizing features of the patent claims.

With feeding the product according to the invention, the initially named difficulties no longer occur. During operation, the product exits from the multiplicity of the relatively small exit apertures distributed over the circumference of the grinding chamber. The gas serving for drying the product directly passes the orifices and efficiently carries the product along.

Numerous additional advantages and benefits will become apparent to those of ordinary skill in the art upon reading the following detailed description of the preferred embodiments.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

FIG. 1 shows a longitudinal section through an air vortex mill according to the invention with a ring-shaped product supply line with quadratic cross-section located in the grinding chamber, FIG. 2 shows an enlarged segment from FIG. 1, FIG. 3 shows a bird's eye view of the supply line according to FIGS. 1 and 2 in accordance with arrows A, B in FIG. 1, FIG. 4 shows a segment in accordance with the one in FIG. 2, with pipe-shaped supply line, FIG. 5 shows a bird's eye view of a supply line which supports itself on spacer pieces.

DETAILED DESCRIPTION

Figure 6:
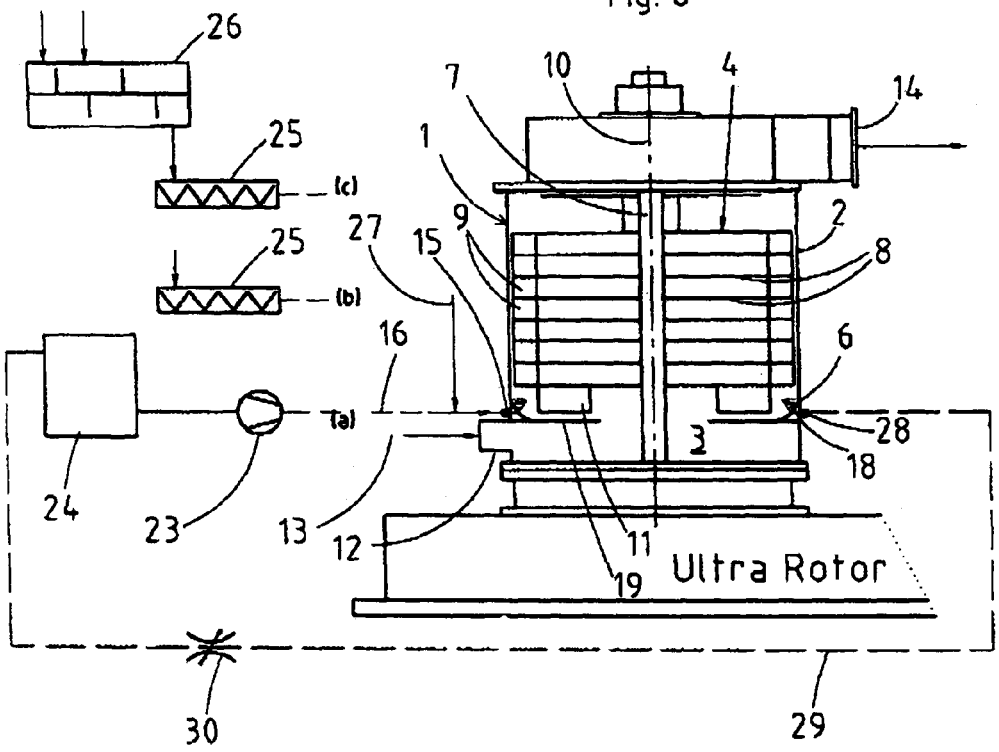
FIG. 6 shows a mill according to the invention with a supply line of triangular cross-section and various devices serving for feeding of the product.

In FIGS. 1 to 9, the mill is respectively identified with 1, its cylindrical housing with 2, its grinding chamber formed by housing 2 with 3, the rotor located in the grinding chamber 3 with 4, the drive motor for rotor 4 with 5, and a ring-shaped product supply line with 6. On the shaft 7 of rotor 4 are located in known fashion (compare U.S. Pat. No. 4,747,550) grinding discs 8, which support grinding plates 9, arranged vertically on the pheriphery. Not shown are impingement surfaces supported by the cylindrical housing wall 2, facing the grinding plates 9. The rotor axis, essentially extending vertically, is identified with 10, the outlet of the mill with 14.

On its under-side, rotor 4 is equipped with a ventilator disc and/or a blower wheel 11. It assures adequate supply of preferably hot carrier gas, for example air, which is supplied to the mill during operation via the connection stub 12 (arrow 13). The product supply lines 6 represented in FIGS. 1 to 7 are located in the lower region of the grinding chamber 3. They are respectively fitted with a connection stub 15, leading to the exterior, by means of which the delivery of the product takes place (arrow 16). In the interior of the grinding chamber the supply lines 6 present boreholes forming outlet apertures 18, through which the supplied product enters into the grinding chamber 3. The outlet apertures 18 are essentially uniformly distributed over the circumference of the grinding chamber 3. Depending upon the supplied product, the diameters of the boreholes measure from one to several millimeters. They are appropriately designed in such fashion that the product is essentially sprayed vertically in upward direction. With the aid of the ventilator 11, arranged approximately at the level of the outlet apertures 18, and an annular disc 19 located underneath, the hot air entering through stub 12 is radially conducted to the outside in such manner that it efficiently carries along the injected or sprayed-in product (arrows 20 in FIGS. 2 and 4).

In all exemplary embodiments, the supply lines 6 are respectively designed as annular lines, which envelope the lower region of the grinding chamber 3. The objective of the essentially uniform product supply would also be attained by a supply line 6 which is designed as ring segment, which envelopes, only partially, preferably predominantly, the lower region of the grinding chamber 3. The supply line 6 may comprise several segments, which can be dismantled in simple fashion and cleaned externally. In addition, it may be appropriate to provide a device that can be operated from the outside, with the aid of which it is possible to change the cross-section of the outlet apertures 18.

In the embodiment according to FIG. 5, spacer pieces 21 are provided which are fastened to the housing wall 2 and which support the annular line 6. The annular line 6 appropriately supports itself upon additional, not visible spacer pieces, which extend between the bottom of the mill 1 and the annular line 6. The benefit of said measure is based on the fact that cleaning of the grinding chamber 1 is more convenient in the area of the supply line 6.

FIG. 6 presents a mill 1 with a supply line 6 having triangular cross-section. Three variations of product supply are schematically represented with (a), (b) and (c). If the product is sufficiently liquid, it can be transported according to variation (a) with the aid of a pump 23, whose outlet is connected via supply line 16 with the connection stub 15, from a supply reservoir 24 into the annular line 6.

Products of more viscous consistency can be conducted in known fashion by means of a screw 25 (variations b and c). A component of variation (c) is a prior positioned mixer 26, in which the crude product can be mixed together with already dried product and other materials, such as carrier materials, added substances or similar.

In the exemplary embodiment according to FIG. 6, an additional line is represented which issues into the product supply line 16. It can—if needed—serve for supply of gas at higher pressure, for example, compressed air. This kind of pressure actuation has the effect of increased flowing ability of the product and reduction in clogging risk of supply apertures 18.

The annular line 6 of the exemplary embodiment according to FIG. 6 is equipped with two connection stubs 15 and 28, which are approximately opposite each other. The connection stub 28 is followed by a line 29 which issues into the supply reservoir 24. Line 29 circulates product which failed to enter the grinding chamber 3 via the outlet apertures 18. That solution makes it possible to regulate the pressure in the annular line 6 by means of pressure control in the return line 29 (for example via adjustable bottle-neck).

Figure 7:
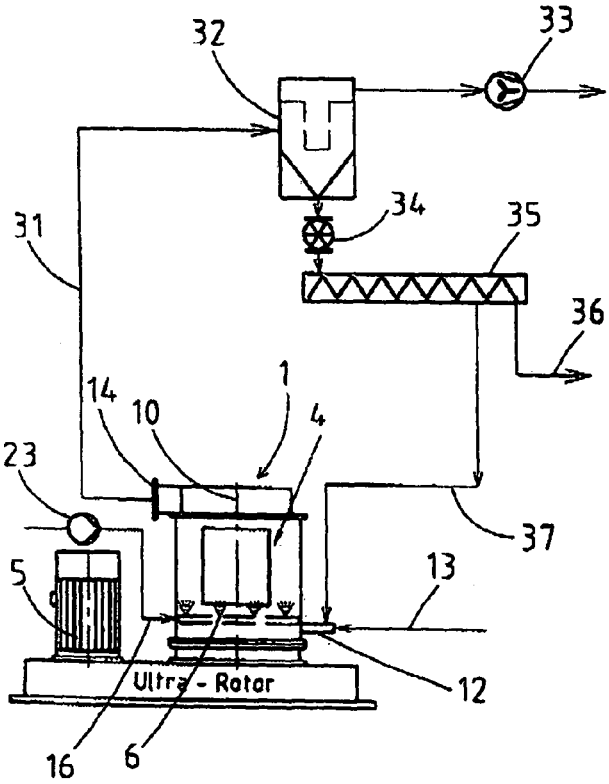
FIG. 7 shows system with a mill according to the invention, in which a portion of the dry product is re-transported into the mill for re-powdering.

In the system depicted in FIG. 7, the outlet 14 of the mill 1 is connected via line 31 with a filter 32. The ventilator 33 which is connected with the sifter 32 serves in known fashion for transport of the dried product. The end product comes via a cellular wheel charging valve 34 into a transportation means, in this case a conveyor screw 35, whose outlet is identified with 36. The screw 35 is additionally connected via a line 37 with the connection stub 12 serving for supply of hot air. By this method, "re-powdering" can be implemented, which is particularly effective, since the partially returned, already dry product is transported to the grinding chamber 3 together with the hot air.

Figure 8:
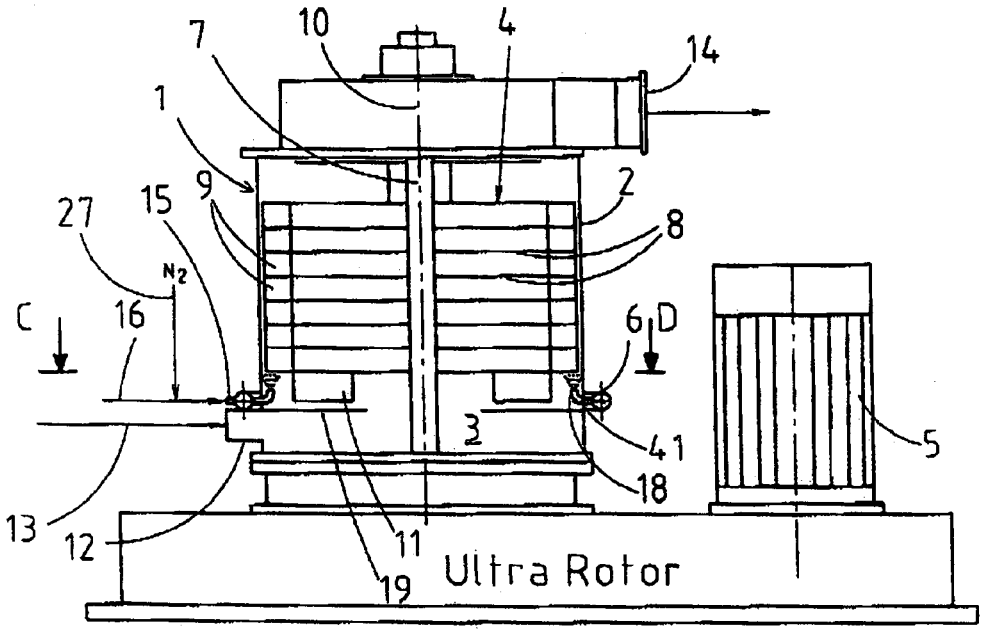
FIGS. 8 and 9 show an embodiment of a mill according to the invention for which the supply line is arranged outside the grinding chamber.
Figure 9:
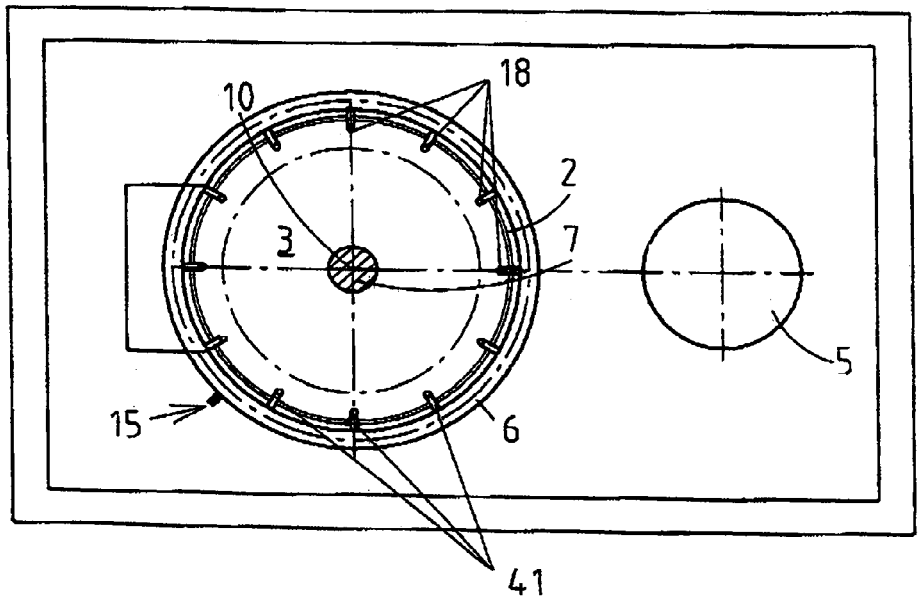

FIGS. 8 and 9 depict an exemplary embodiment for a mill 1 according to the invention with an annular line 6, which is located outside of the grinding chamber 3. The annular line 6 is connected with the grinding chamber 3 via a multiplicity of preferably bent small pipes 41. The ends of the small pipes 41 located within the grinding chamber 3 form the outlet aperture 18 for the product to be dried.

In the event that it should be necessary to cool the small pipes 41 which penetrate the housing wall 2, these may be designed with—a dual wall, and a cooling agent may flow through the thereby produced surrounding space. As depicted in FIG. 8, there also exists the possibility of feeding into supply line 16, via line 27, cold gases, for example cooled nitrogen, which increases, at the same time, the flow ability of the product.

During operation of the depicted exemplary embodiments, the product to be dried exits from the multiplicity of outlet apertures 18 into the grinding chamber 3. The hot air, supplied via connection stub 12 and steered with the aid of annular disc 19 and blower wheel 11 in the direction of the outlet apertures 18, carries along the product and transports it into the grinding slot between the grinding plates 9 and the not represented impingement surfaces. There, effective vortex and drying action takes place, and, depending upon product, further comminution as well. The final product leaves the mill at 14 and is conducted—as represented for example in FIG. 7—via a filter to another transport means 35. In principle, all flowable products can be treated in the described fashion.

The following are some examples:

Aluminum hydroxide: Entry as slurry with 55-70% H2O dried to 0.2% H2O

Yeast cell peelings: Entry as slurry 85% H2O dried to 3-5% H2O

Partially autolyzed yeast: Entry as slurry 85% H2O dried to 3-5% H2O

CaCO3: Entry as slurry 35% H2O dried to 0.1% H2O

Pigments: Entry as slurry 55-70% H2O dried to 0.1% H2O

Titanium dioxide: Entry as slurry 60-65% H2O dried to 0.1% H2O

Plant Proteins: Entry as suspension or pumpable mass 60-65% H2O dried to 6-8% H2O Wheat Process Water from starch factory: Entry as suspension with soluble substances 88-90% H2O dried to 6% H2O with yeast bran molasses as carrier agent When compared with state of the art methods, significant improvement is achieved in the evaporation efficiency and grinding output, amounting in some products to more than 50%.

In addition, there is the benefit that the invention also permits thorough cleaning and subsequent drying of the grinding chamber 3. For that purpose, cleaning liquid is sprayed into the grinding chamber 3 via the supply line 6. The cleaning phase is then followed by drying via hot air, which, in this case, is appropriately likewise supplied to the grinding chamber 3 via supply line 6.

The invention has been described with reference to the preferred embodiments. Modifications and alterations may occur to others upon reading and understanding the preceding detailed+description. It is intended that the invention be construed as including all such modifications and alterations insofar as they come within the scope of the appended claims or the equivalents thereof.

The invention claimed is:

1. An air vortex mill for mill drying of flowable product with a gas-/air flow-through grinding chamber, with several grinding stages arranged in the grinding chamber, the grinding stages being formed by a rotor having a multitude of grinding plates and a stator housing with a carrier gas supply device for the supply of a carrier gas as well as with a product supply device for supplying product to the grinding chamber, the product supply device including a supply line surrounding at least partially a circumference of the grinding chamber, said product supply device being equipped with an inflow for the product and a plurality of outlet apertures distributed over the circumference of the grinding chamber through which outlet apertures the product issues concurrently into the grinding chamber.

2. The air vortex mill according to claim 1, wherein the outlet apertures are located in a lower region of the grinding chamber.

3. The air vortex mill according to claim 1, wherein the outlet apertures are arranged and designed in such fashion that the exiting product has an essentially upwardly oriented flow direction.

4. The air vortex mill according to claim 1, wherein the supply product line is located inside the grinding chamber.

5. The air vortex mill according to claim 4, the outlet apertures are defined by bores in the supply line which concurrently issue into the grinding chamber.

6. The air vortex mill according to claim 4, wherein the supply line is located in a lower region of the grinding chamber.

7. The air vortex mill according to claim 6, wherein the supply line is integrated in the bottom of the grinding chamber.

8. The air vortex mill according to claim 6, wherein the supply line is supported on spacer pieces.

9. The air vortex mill according to claim 1, wherein the supply line is located outside the stator housing.

10. The air vortex mill according to claim 1, wherein the supply line is an annular line.

11. The air vortex mill according to claim 1, wherein the rotor on the entry side is equipped with a blower wheel which is located approximately at the level of the outlet apertures.

12. The air vortex mill according to claim 1, wherein the supply line is equipped with only one connection stub for the supply of product from a supply reservoir.

13. The air vortex mill according to claim 1, wherein the supply line is equipped with two connection stubs positioned approximately opposite each other, one of which serving for delivery of product and the second for return into a supply reservoir via a line of product not sprayed into the grinding chamber.

14. The air vortex mill according to claim 13, wherein the return line is equipped with a device for steering the pressure in the supply line.

15. The air vortex mill according to claim 1, wherein the supply line includes at least one connection stub, the connection stub being in communication with a line serving for the delivery of gases.

16. The air vortex mill according to claim 1, wherein an outlet of the mill is in communication via a line with a filter, an outlet of the filter is in communication with a transport means and the transport means is in communication via a line with the entry region of the mill.

17. The air vortex mill according to claim 16, wherein the line connected with the entry region is in communication with the device serving for the delivery of the carrier gas.

18. The air vortex mill according to claim 1, wherein a cross-section of the outlet apertures is adjustable.

19. The air vortex mill according to claim 1, wherein the supply line includes a plurality of dismountable segments.

20. A method for mill grinding a flowable product with the aid of the air vortex mill according to claim 1, wherein the product to be dried is transported via the supply line to the plurality of outlet apertures distributed over the circumference of the grinding chamber, and concurrently through the plurality of outlets into the grinding chamber, and the grinding chamber is supplied with gases in such manner that they intermingle in the mill with the product to be dried.

21. The method according to claim 20, wherein the gases are fed into the supply line under increased pressure.

22. The method according to claim 20, wherein a portion of the dried product is transported back into an entry region of the mill.

23. The method according to claim 22, characterized in that the returned product is transported together with the carrier gas into an entry region of the mill.

24. A air vortex mill for mill drying of flowable product with a gas-/air flow-through grinding chamber, with several grinding stages arranged in the grinding chamber, the grinding stages being formed by a rotor having a multitude of grinding plates and a stator housing with a device for the supply of a carrier gas as well as with a device for supplying product to the grinding chamber, the product supply device including a supply line surrounding at least partially a circumference of grinding chamber, said product supply device being equipped with an inflow for the to be treated product and a plurality of outlet apertures distributed over the circumference of the grinding chamber issuing into the grinding chamber, the outlet apertures being formed by pipe segments which are connected at one end with the supply line, which penetrate the housing wall and end in the grinding chamber.

25. The air vortex mill according to claim 24, wherein the pipe segments are designed with dual walls.

* * * * *